United States Patent [19]

Bennett

[11] Patent Number: 5,033,654

[45] Date of Patent: Jul. 23, 1991

[54] FOAM DISPENSER

[75] Inventor: Robert A. Bennett, Easton, Conn.

[73] Assignee: R.J.S. Industries, Inc., Marlboro, N.J.

[21] Appl. No.: 483,634

[22] Filed: Feb. 23, 1990

[51] Int. Cl.[5] ..... B67D 5/58

[52] U.S. Cl. ..... 222/190; 222/211; 222/484; 222/532

[58] Field of Search ..... 222/189, 190, 209, 211, 222/212, 522, 531, 532, 484; 239/343

[56] References Cited

U.S. PATENT DOCUMENTS

| | | | |
|---|---|---|---|
| 4,156,505 | 5/1979 | Bennett | 239/343 X |
| 4,509,661 | 4/1985 | Sugizaki et al. | 222/190 |
| 4,531,659 | 7/1985 | Wright | 222/211 X |
| 4,615,467 | 10/1986 | Grogan et al. | 222/211 X |
| 4,802,610 | 2/1989 | Cheek et al. | 222/532 X |
| 4,807,785 | 2/1989 | Pritchett | 222/484 X |

FOREIGN PATENT DOCUMENTS

| | | | |
|---|---|---|---|
| 961015 | 1/1975 | Canada | 222/211 |

*Primary Examiner*—Michael S. Huppert
*Assistant Examiner*—Gregory L. Huson

[57] ABSTRACT

A foam dispenser utilizes a deformable reservoir of foamable fluid and air, a discharge device and an arrangement for producing foam which includes a foam overlay or filter. When the dispenser is operated, air from inside the dispenser is mixed with the fluid to produce foam. The dispenser employs a check valve in the form of a ball and cylinder disposed outside of the path of liquid flow for use in controlling the backward flow of air from outside the dispenser into the interior to recharge the air supply within the dispenser for use in subsequent foam dispensing operations.

8 Claims, 1 Drawing Sheet

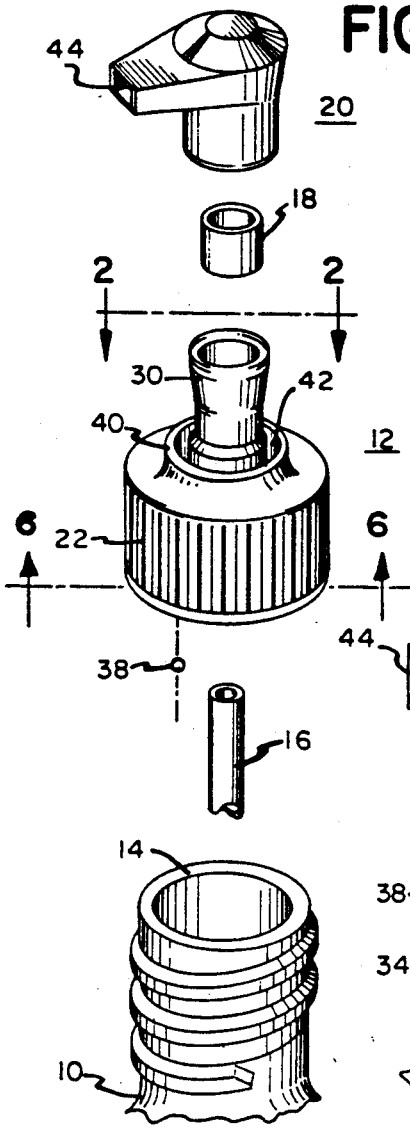
FIG. 1
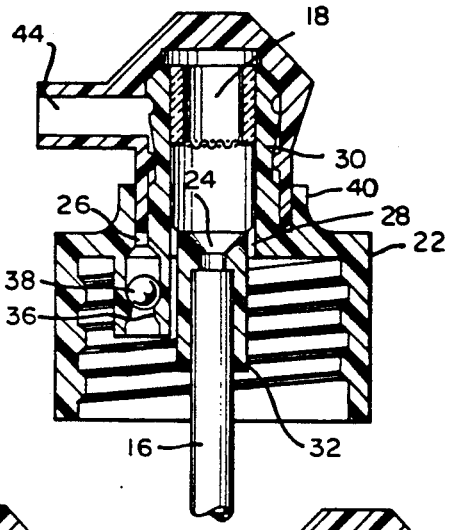
FIG. 3
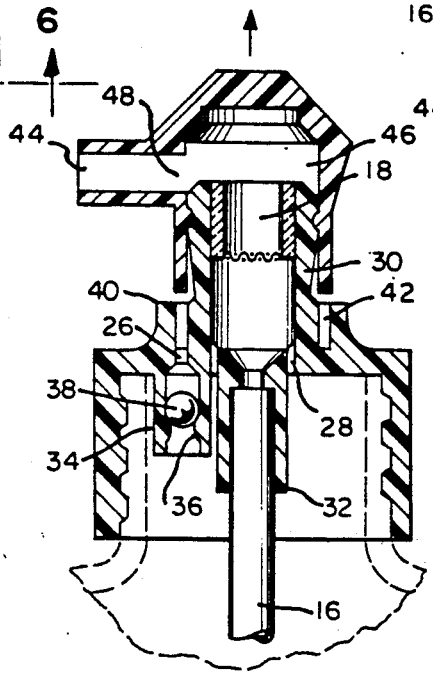
FIG. 4
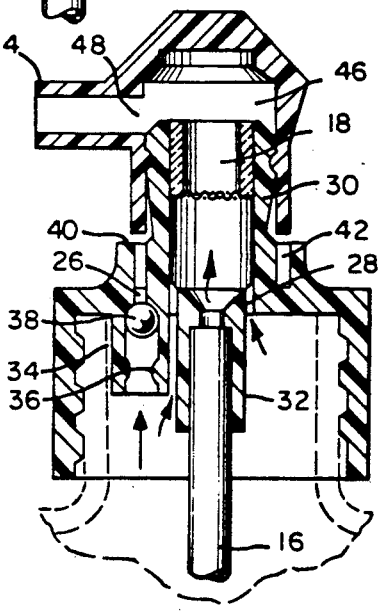
FIG. 5
FIG. 2
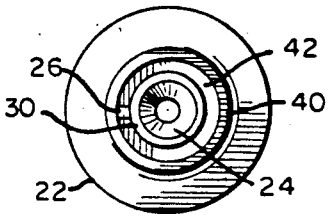
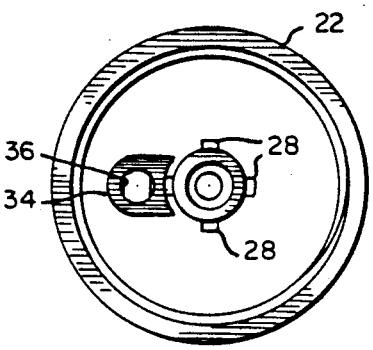
FIG. 6

FOAM DISPENSER

BACKGROUND OF THE INVENTION

Certain known types of foam producing devices, as disclosed for example in U.S. Pat. Nos. 4,147,306 and 4,156,505, employ a deformable reservoir of foamable fluid and air, discharge means, and foam producing means which include both a foam overlay or filter and a ball check valve. The foam producing means has some type of well with air passages which form a mixing chamber. When the reservoir is squeezed, the liquid and air are mixed in the chamber. The mixture is passed through the overlay to produce foam which is discharged through the orifice means. The check valve is disposed in the path of liquid flow, is opened by the squeezing action and is closed when the pressure is released. The valve when closed prevents downward flow or liquid or foam which otherwise could clog or jam the dispenser.

However, such known arrangements suffer from certain other disadvantages. For example when the device is turned upside down, the valve is opened and liquid can flow out of the device or can remain in the well whereby subsequent foam producing actions will not be satisfactory because the ratio of liquid to air in the mixing action is adversely affected.

In the present invention, these disadvantages are overcome by using a check valve disposed out of the path of liquid flow, the check valve being used to control the backward flow of air from outside the device into the the interior to recharge the air supply used in subsequent foam dispensing operations.

SUMMARY OF THE INVENTION

In accordance with the principles of the invention, a first vertical hollow cylinder has an open lower end and a closed upper end and is adapted to engage an open neck of a container of liquid. The upper end has a first centrally disposed opening, a second opening spaced from the first opening, and a plurality of third openings disposed in spaced apart position about the first opening and positioned between the first and second openings.

A second vertical hollow cylinder extends through the first opening, the second cylinder having an upper section of larger diameter extending upwardly from the closed upper end of the first cylinder and a lower section of smaller diameter extending downwardly from the closed upper end of the first cylinder to a position intermediate the ends of the first cylinder. The upper section is disposed between the second opening and the third openings; the lower section is disposed between the first opening and the third openings. The upper end of the lower section and the lower end of the upper section communicate with each other through the first opening. The upper end of the upper section is open; the lower end of the lower section is open and is adapted to receive a dip tube.

A third vertical hollow cylinder extends downwardly through the second opening, with an upper open end coincident with the second opening and a lower open end positioned between the ends of the first cylinder. The third cylinder has a constriction disposed between its ends and adjacent its lower end. A ball is slidable in the third cylinder between its upper end and the constriction, the ball normally engaging the constriction. The ball and third cylinder constitute a check valve wherein air can flow between the ball and constriction and through the third cylinder unless the valve is closed by the ball engaging and closing the upper end of the third cylinder.

A fourth hollow cylinder has an open upper end and is secured at its lower end to the upper end of the first cylinder. The fourth cylinder is disposed concentrically about the upper section of the second cylinder and separated therefrom by an annular region, the second opening being disposed in the annular region.

A cap nozzle has a horizontal discharge conduit section and a vertical hollow cylindrical section. The horizontal section has an outer discharge end and an inner intake end. The vertical section has an upper end which is connected to the intake end and a lower open end.

The upper section of the second cylinder extends into the vertical cylindrical section, the nozzle being vertically movable between a down position at which the vertical section extends into said annular region and closes the second opening and the upper section of the second cylinder closes the inner intake end and an up position at which the second opening is exposed to ambient air and air can pass from the interior of the first cylinder through the third openings and through the upper section into the horizontal section. A filter is disposed in the upper section of the second cylinder and extends downwardly therein.

In use, the first cylinder is secured to the open neck of a container of fluid and the dip tube is placed in position and extends into the container to a depth below the fluid level. When the nozzle in the up position and the container is squeezed, the valve is closed. Air flow takes place as described above and the fluid flows upwardly through the dip tube. The fluid and air are mixed together in the upper section of the second cylinder and the mixture passes through the filter and is converted to foam. The foam flows through the horizontal section of the nozzle and is discharged together in the filter and are discharged as foam.

When the squeezing pressure is released, the valve is opened and air is fed through the valve into the container to replace the air previously used to produce foam. After the pressure is released, the nozzle is placed in the down position. The dispenser is sealed and fluid cannot leak out even if the dispenser is tilted or inverted.

BRIEF DESCRIPTION OF THE DRAWINGS

FIG. 1 is an exploded view of a preferred embodiment of the invention.

FIG. 2 is a view taken along line 2—2 in FIG. 1.

FIG. 3 is a cross sectional view of the embodiment of FIG. 1 in assembled form with the nozzle in down position.

FIG. 4 is a view similar to FIG. 3 but with the nozzle shown in up position prior to application of squeezing pressure.

FIG. 5 is a view similar to FIG. 4 with the nozzle shown in up position immediately after application of squeezing pressure.

FIG. 6 is a view taken along line 6—6 in FIG. 1.

DETAILED DESCRIPTION OF PREFERRED EMBODIMENT

Referring now to FIGS. 1-6, a sqeezable plastic container 10 contains foamable fluid or liquid. A plastic member 12 is screwed on the open threaded neck 14 of container 10. A plastic dip tube 16 extends downwardly from the member 12 into the container to a point below the level of the fluid. A plastic filler 18 is dipsosed in the member 12. A plastic cap nozzle 20 is connected to the member.

Member 12 is provided with a first vertical hollow cylinder 22 that has an open lower end and a closed upper end. Cylinder 22 has an internal thread and is adapted to engage an open neck 24 of container 10. The upper end of cylinder 22 has a first centrally disposed opening 24, a second opening 26 spaced from the first opening, and a plurality of third openings 28 disposed in spaced apart position about the first opening and positioned between the first and second openings.

A second vertical hollow cylinder extends through the first opening. The second cylinder has an upper section 30 of larger diameter extending upwardly from the closed upper end of the first cylinder and a lower section 32 of smaller diameter extending downwardly from the closed upper end of the first cylinder to a position intermediate the ends of the first cylinder. The upper section is disposed between the second opening and the third openigns; the lower section is disposed between the first opening and the third openings. The upper end of the lower section and the lower end of the upper section communicate with each other through the first opening. The upper end of the upper section is open; the lower end of the lower section is open and is adapted to receive the dip tube.

A third vertical hollow cylinder 34 extends downwardly through the second opening, with an upper open end coincident with the second opening and a lower open end positioned between the ends of the first cylinder. The third cylinder has a constriction 36 disposed between its ends and adjacent its lower end. A ball 38 is slidable in the third cylinder between its upper end and the constriction, the ball normally engaging the constriction. The ball and third cylinder constitute a check valve wherein air can flow between the ball and constriction and through the third cylinder unless the valve is closed by the ball engaging and closing the upper end of the third cylinder.

A fourth hollow cylinder 40 has an open upper end and is secured at its lower end to the upper end of the first cylinder. The fourth cylinder is disposed concentrically about the upper section of the second cylinder and spaced therefrom by an annular recess 42, the second opening being disposed in the annular region.

The cap nozzle has a horizontal discharge conduit section 44 and a vertical hollow cylindrical section 46. The horizontal section has an outer discharge end and an inner intake end 48. The vertical section has an upper end whichis connected to the intake end and has a lower open end.

The upper sectin of the second cylinder extends into the vertical cylindrical section, the nozzle being vertically movable between a down position at which the vertical section extends into said annular region and closes the second opening and the upper section of the second cylinder closes the inner intake end and an up position at which the second opening is exposed to ambient air and air can pass from the interior of the first cylinder through the third openings and through the upper section into the horizontal section. The filter is disposed in the upper section of the second cylinder and extends downwardly therein.

In use, the first cylinder is secured to the open neck of the container and the dip tube is placed in position to extend into the container to a depth below the fluid level. When the nozzle is in the up position and the container is squeezed, the valve is closed. Air flow takes place as described above and the fluid flows upwardly through the dip tube. The fluid and air are mixed together in the upper section of the second cylinder and the mixture passes through the filter and is converted to foam. The foam flows through the horizontal section of the nozzle and is discharged together in the filter and are discharged as foam.

The upper portion of the upper section 30 flares slightly outward to hold the nozzle by friction in the up position.

What is claimed is:

1. A foam dispenser comprising:

a first vertical hollow cylinder having an open lower end and a closed upper end and adapted to engage an open neck of a container of liquid, the upper end having a first centrally disposed opening, a second opening spaced from the first opening, and a plurality of third openings disposed n spaced apart position about the first opening and positioned between the first and second openings;

a second vertical hollow cylinder extending through the first opening, the second cylinder having an upper section of larger diameter extending upwardly from the closed upper end of the first cylinder and a lower section of smaller diameter extending downwardly from the closed upper end of the first cylinder to a position intermediate the ends of the first cylinder, the upper section being disposed between the second opening and the third openings, the lower section being disposed between the first opening and the third openings, the upper end of the lower section and the lower end of the upper section communicating with each other through the first opening, the upper end of the upper section being open, the lower end of the lower section being open and receiving a dip tube;

a third vertical hollow cylinder extending downwardly through the second opening, the third cylinder having an upper open end coincident with the seocond opening and a lower open end positioned between the ends of the first cylinder, the third cylinder having a constriction disposed between its ends and adjacent its lower end;

a ball slidable in the third cylinder between its upper end and the constriction, the ball normally engaging the constriction, the ball and third cylinder constituting a check valve wherein air can flow between the ball and constriction and through the third cylinder unless the valve is closed by the ball engaging and closing the upper end of the third cylinder; and a fourth hollow cylinder having an open upper end and secured at its lower end to the upper end of the first cylinder, the fourth cylinder being disposed concentrically about the upper section of the second cylinder and separated therefrom by an annular recess, the second opening being disposed in the annular recess.

2. The dispenser of claim 1 further including a cap nozzle having a horizontal discharge conduit section and a vertical hollow cylindrical section, the horizontal section having an outer discharge end and an inner intake end, the vertical section having an upper end which is connected to the intake end and a lower open end, the upper section of the second cylinder extending into the vertical cylindrical section, the nozzle being vertically movable between a down position at which the vertical section extends into said annular recess and closes the second opening and the upper section of the second cylinder closes the inner intake end and an up position at which the second opening is exposed to ambient air and air can pass from the interior of the first cylinder through the third openings and through the upper section into the horizontal section.

3. The dispenser of claim 2 further including a filter disposed in the upper section of the second cylinder and extending downwardly therein.

4. The dispenser of claim 3 wherein the first cylinder is secured to the open neck of a container of fluid and the dip tube is in position and extends into the container to a depth below the fluid level.

5. The dispenser of claim 4 wherein when the nozzle is in the up position and the container is squeezed, the valve is closed and fluid and air mix together and are discharged as foam through the filter and nozzle.

6. The dispenser of claim 5 wherein when the squeezing pressure is released, the valve is opened and air is fed through the valve into the container.

7. The dispenser of claim 6 wherein after the pressure is released and the nozzle placed in the down position, the dispenser is sealed and cannot leak.

8. The dispenser of claim 7 wherein when the nozzle is in the down position, neither air nor liquid can flow out of the container and air cannot flow into the container.

* * * * *